US005860635A

United States Patent [19]

Morfitt et al.

[11] Patent Number: 5,860,635

[45] Date of Patent: Jan. 19, 1999

[54] WINCH HAVING HYDRAULIC SPEED CONTROL AND PLANETARY GEAR SYSTEM

[75] Inventors: Jeffrey Morfitt; Barrie Freeke, both of Langley, Canada

[73] Assignee: Seascape Systems Limited, St. John's Newfoundland, Canada

[21] Appl. No.: 576,683

[22] Filed: Dec. 21, 1995

[51] Int. Cl.[6] ..... B66D 5/02

[52] U.S. Cl. ..... 254/377; 254/344; 254/378; 188/290

[58] Field of Search ..... 254/276, 377, 254/378, 344, 356; 188/290

[56] References Cited

U.S. PATENT DOCUMENTS

| | | | |
|---|---|---|---|
| 152,718 | 6/1874 | Wyman | 254/377 |
| 1,046,675 | 12/1912 | Swedenborg | 114/373 |
| 1,359,993 | 11/1920 | House | 254/276 |
| 1,446,562 | 2/1923 | Hickman | 254/378 X |
| 1,543,402 | 6/1925 | Stevens | 477/9 |
| 1,843,793 | 2/1932 | Wagner | 414/683 |
| 1,888,912 | 11/1932 | Doose | 242/396 |
| 1,985,889 | 1/1935 | De La Mater et al. | 254/377 X |
| 2,246,923 | 6/1941 | Meunier | 254/356 |
| 2,517,621 | 8/1950 | Anderson | 254/378 X |
| 2,873,055 | 2/1959 | Hill | 182/19 |
| 2,883,013 | 4/1959 | Keith et al. | 254/378 X |
| 2,891,767 | 6/1959 | Armington | 254/344 |
| 3,034,767 | 5/1962 | Gordon | 254/327 |
| 3,261,590 | 7/1966 | Bech et al. | 254/377 X |
| 3,265,358 | 8/1966 | Delaney | 188/294 |
| 4,679,666 | 7/1987 | Brems | 188/290 |

*Primary Examiner*—Daniel P. Stodola
*Assistant Examiner*—Emmanuel M. Marcelo
*Attorney, Agent, or Firm*—Nath & Associates; Gary M. Nath

[57] ABSTRACT

A new and useful winch comprising a cable drum; a motor operatively connected to drive a cable drum; a fall arrestor operatively connected to a cable drum and having no power input requirement and a gear reduction group through which a motor and fall arrestor are operatively connected to a cable drum.

16 Claims, 6 Drawing Sheets

WINCH HAVING HYDRAULIC SPEED CONTROL AND PLANETARY GEAR SYSTEM

FIELD OF THE INVENTION

This invention relates to winches. One application of the winches of the invention is in lowering evacuation craft from offshore drilling platforms, but the winches are in no way limited to that application.

BACKGROUND OF THE INVENTION

There has been an ongoing loss of life in tragic accidents on offshore drilling platforms partly due to the inadequacy of evacuation systems to remove personnel from platform in emergency situations. For example, it has been reported that evacuation systems have to-date had a failure rate in the order of 86%. This has led to ongoing efforts to improve evacuation systems.

One such system developed by the present applicant is based on an arrangement in which an elongated deployment arm is mounted at the side of a platform with the totally enclosed motor propelled survival craft (TEMPSC) supported at the end of the deployment arm. In an emergency situation the TEMPSC is loaded and the deployment arm pivoted down to the surface of the sea, controlled by a winch and cable.

An important aspect of the system is the winch. The winch must fulfil a number of stringent design criteria. These include the fundamental requirement that the winch be capable of deploying the TEMPSC in a situation where there is an electrical power outage on the platform. The launch must obviously be at an acceptable low rate of speed and so a significant amount of energy must be dissipated by the winch. Furthermore, the winch must then be capable of recovering the TEMPSC and restoring it to the ready position. This last function is of particular importance for test purposes.

In addition to the operational requirements, the winch must be capable of operating in a hostile environment and must remain in top operating condition with minimum maintenance.

It is against this background that the present invention arises.

PRIOR ART

Applicant was unable to locate any existing winch which would meet its requirements.

The following U.S. patents, directed to winches, are of general background interest.

U.S. Pat. No. 152,718, to Wyman, issued 30 Jun. 1874, describes an early form of hydraulic brake utilizing an orifice and for use in elevators.

U.S. Pat. No. 1,046,675, to Swedenborg, issued 10 Dec. 1912, illustrates an early form of hydraulic brake utilizing a double acting piston and cylinder.

U.S. Pat. No. 1,359,994, to House, issued 23 Nov. 1920, illustrates a form of hydraulic control for winch speed. The speed is constantly controlled and may be varied by the operator.

U.S. Pat. No. 1,543,402, to Stevens, issued 23 Jun. 1925, illustrates an hydraulic brake arrangement for use in association with an elevator electric motor. A solenoid device is used to activate the brake.

U.S. Pat. No. 1,843,793, to Wagner, issued 2 Feb. 1932, illustrates a further hydraulic brake system for controlling speed and adding a safety feature in a part of a paving machine.

U.S. Pat. No. 1,888,912, to Doose, issued 22 Nov. 1932, illustrates a means for lowering lifeboats continuously controlled from the lifeboat. The entire winch is required to move horizontally along a screw shaft.

U.S. Pat. No. 2,246,923, to Meunier, issued 26 Jul. 1938, relates to an hydraulic brake mechanism for hoists.

U.S. Pat. No. 2,873,055, to Hill, issued 10 Feb. 1958, illustrates a fire escape device utilizing an hydraulic band brake means for controlling speed of descent. Braking action is proportional to speed of descent.

U.S. Pat. No. 3,265,358, to Delaney, issued 9 Aug. 1966, illustrates a reversible hydraulic brake arrangement utilizing a pair of orifices.

BRIEF DESCRIPTION OF THE DRAWINGS

In drawings which illustrate embodiments of the invention.

Figure 1:
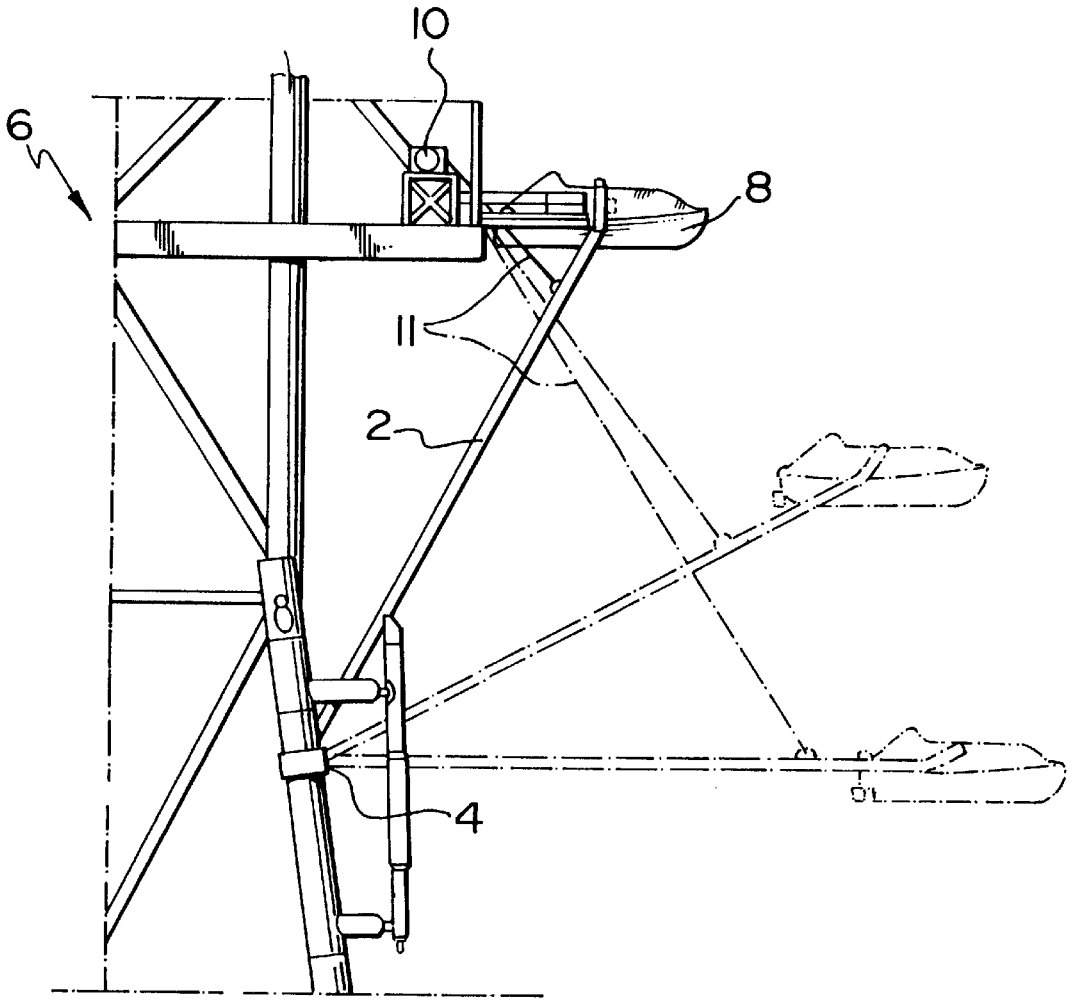
FIG. 1 illustrates an evacuation system of which the position of the major components is shown.

While the invention will be described in conjunction with illustrative embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

FIG. 1 illustrates the general layout of an evacuation system for an offshore platform in association with which the winch of the present invention may be used. A deployment arm 2 is rotatably mounted at 4 on the support structure of platform 6. A lifeboat (TEMPSC) 8 is supported adjacent the end of arm 2. Deployment and retrieval of arm 2 are controlled by the winch 10 by means of cable 11.

Figure 2:
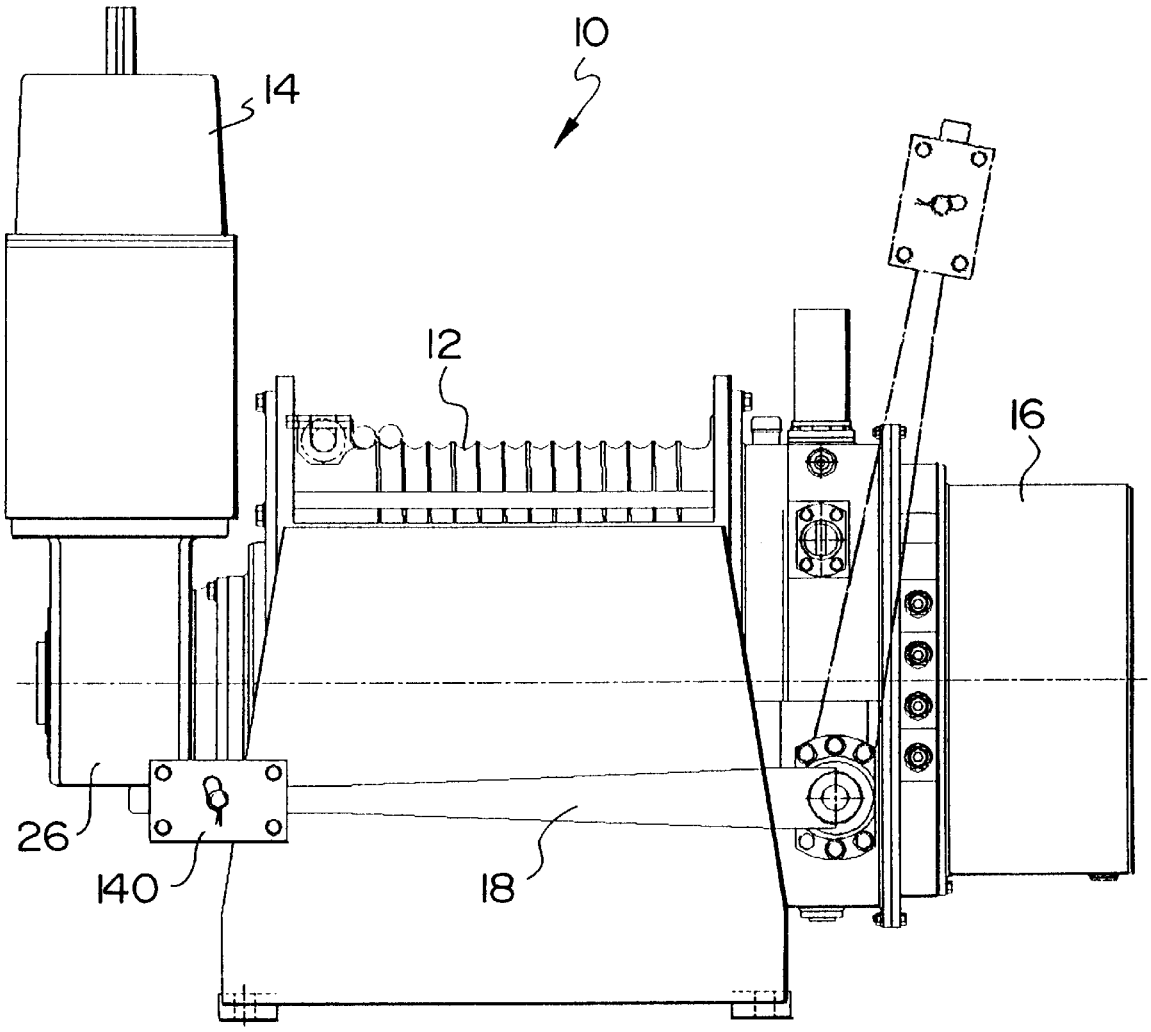
FIG. 2 is a front view of a winch according to the invention.
Figure 3:
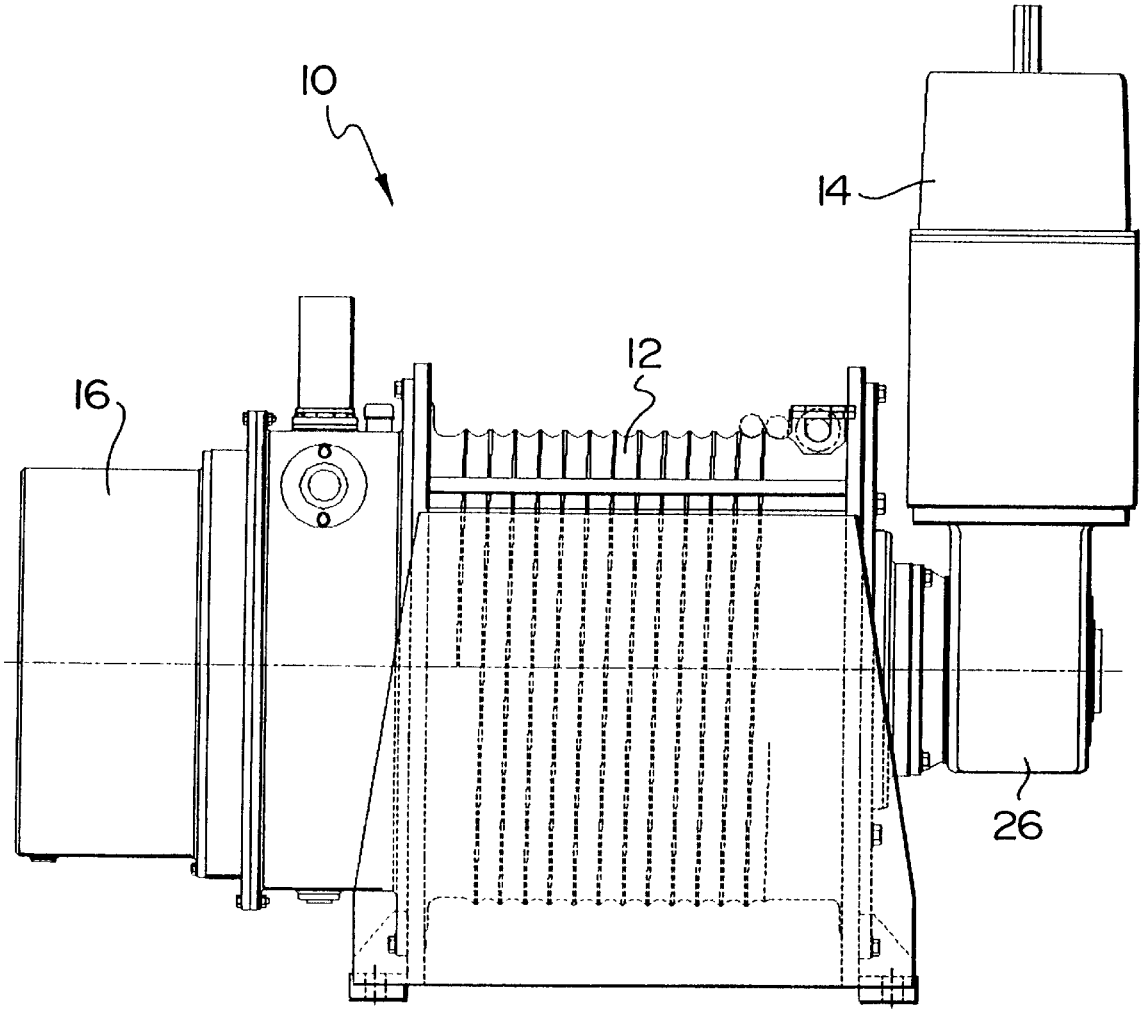
FIG. 3 is a rear view of a winch according to the invention.

FIGS. 2 and 3 illustrate the general arrangement of components of a winch 10 according to the invention. These figures illustrate in a preferred embodiment the relative position of cable drum 12, motor housing 14 and fall arrestor housing 16. Also shown is a brake actuator lever 18.

Figure 4:
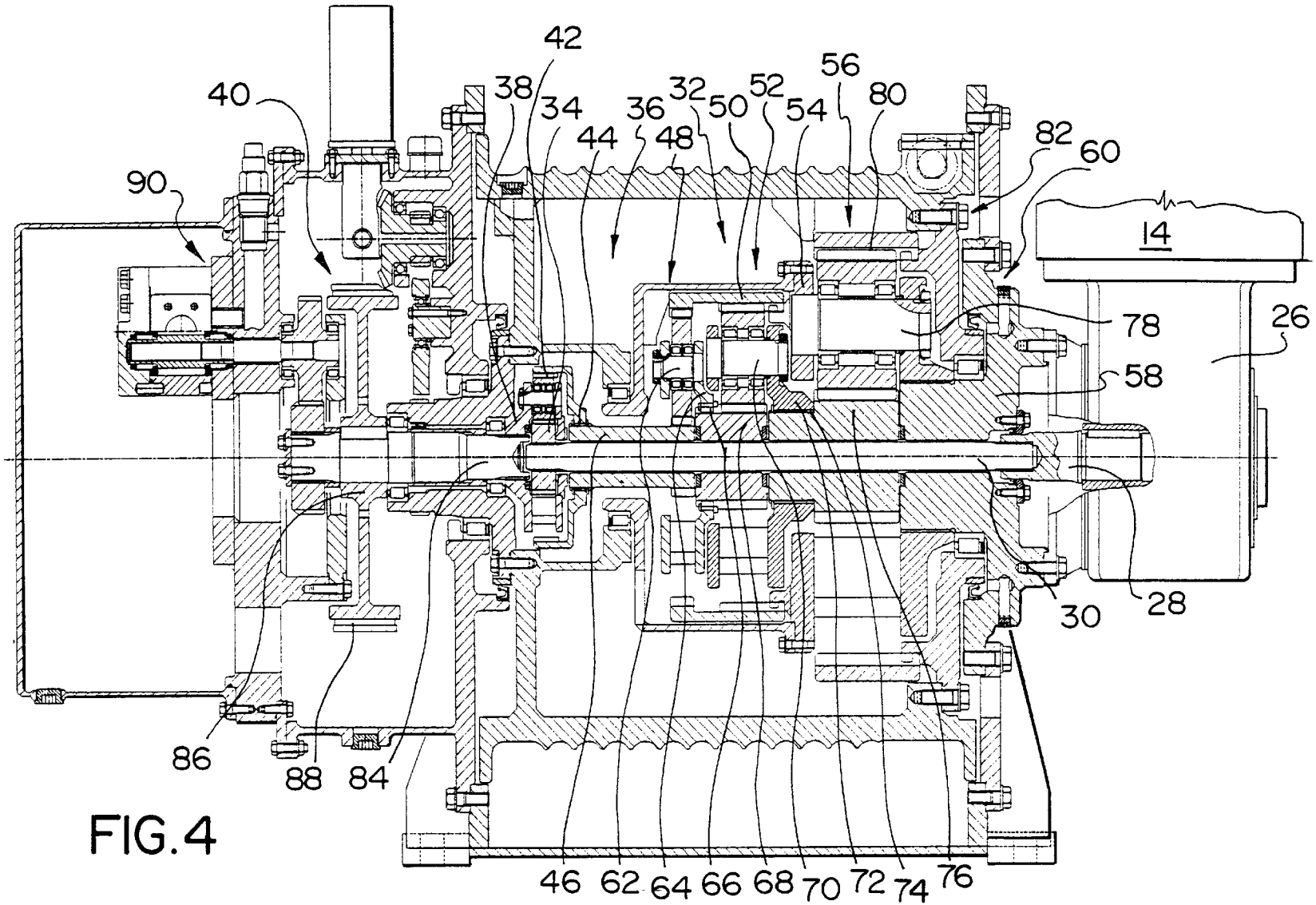
FIG. 4 is a section illustrating a winch assembly according to the invention.
Figure 5:
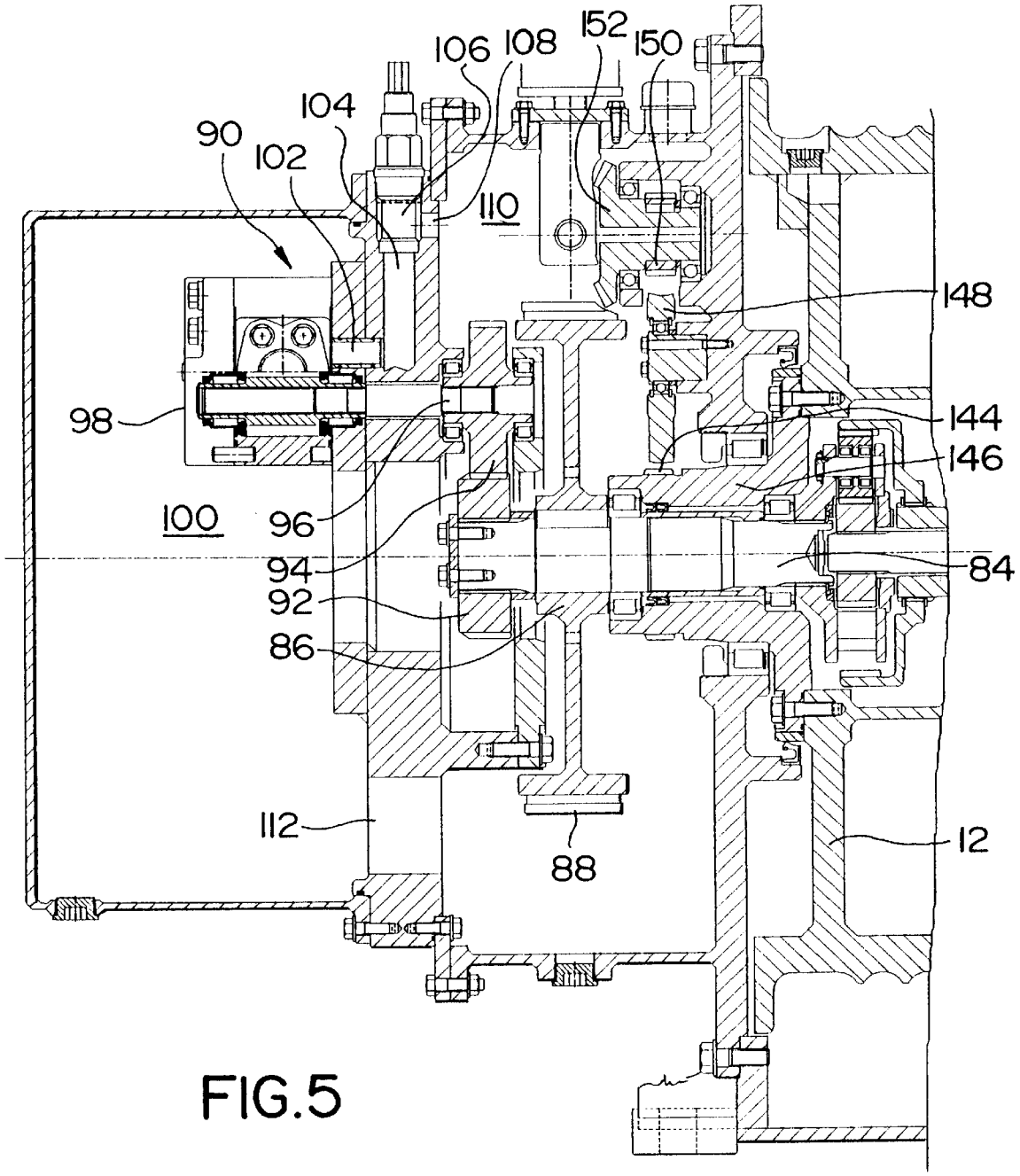
FIG. 5 is a section illustrating a part of the winch assembly of FIG. 4.

With reference to FIGS. 4 and 5, motor housing 14 contains a motor 20 connected through a motor output shaft 22 to a gear reducer 24 within gear box 26. Motor 20, motor output shaft 22 and gear reducer 24 are conventional and are not illustrated.

From gear reducer 24 a final motor output shaft 28 extends at 90° and is fixed to a main cable drum shaft 30.

The sole function of the motor is to operate the winch in a retrieval mode for retrieving the deployment arm 2. This may occur after a practice drill or where an emergency situation no longer exists so that personnel may immediately return to the platform.

The motor is thus preferably provided with a conventional backstop or spragg-type clutch and a friction brake to ensure that the motor cannot drive the winch in a deployment mode to lower deployment arm 2, nor can the winch drum drive the motor in reverse.

The main cable drum shaft 30 drives the winch in the retrieval mode through a gear reduction group 32. In the preferred case gear reduction group 32 comprises a planetary gear system which most preferably consists of four stages. The gear reduction provided by this system is preferably about 200:1. In the retrieval mode, the winch operates as follows.

Sun gear 34 of first stage 36 is fixed on shaft 30 and rotates with that shaft. In the retrieval mode the planet gear carrier 38 of first stage 36 is held against rotation by brake means 40 to be discussed in detail later. Therefore, when shaft 30 is rotated by motor 20, the internal gear 42 of first stage 36 is caused to rotate by shaft 30.

Internal gear 42 of first stage 36 is connected at spline 44 to sun gear 46 of second stage 48. Sun gear 46 is thus caused by internal gear 42 to rotate.

Common internal gear 50 of second stage 48 and third stage 52 is fixed to planet carrier 54 of fourth stage 56. Planet gear carrier 54 is in turn fixed to end flange 58 of winch housing 60. Accordingly, planet carrier 54 and hence, internal gear 50 are held against rotation. Therefore, rotation of sun gear 46 of second stage 48 acting through planet gear 62 of second stage 48 causes planet gear carrier 64 of second stage 48 to rotate.

Planet gear carrier 64 of second stage 48 is connected through spline 66 to sun gear 68 of third stage 52. Sun gear 68 is thus caused to rotate with planet gear carrier 64. Therefore, since internal gear 50 is fixed, sun gear 68 acting through planet gear 70 of third stage 52 causes planet gear carrier 72 of third stage 52 to rotate.

Planet gear carrier 72 of third stage 52 is connected by spline 74 to sun gear 76 of fourth stage 56. Since planet gear carrier 54 of fourth stage 56 is fixed to end flange 58, sun gear 76 acting through planet gear 78 of fourth stage 56 causes internal gear 80 of fourth stage 56 to rotate. Internal gear 80 is fixed as generally illustrated at 82 to cable drum 12. Thus, cable drum 12 is caused to rotate to take up cable 11 to retrieve the deployment arm 2.

To let out cable to lower deployment arm 2, the same gear reduction group 32 is utilized. However, since under no circumstances can the main shaft 30 rotate in the reverse direction, because of the backstop on motor 20, the interaction of the planetary gear system members in first stage 36 is altered. In the retrieval mode planet gear carrier 38 was held against rotation by brake means 40. In the deployment mode, brake means 40 is released, so that planet gear carrier 38 is free to rotate. Since cable drum 12 is, in the ready mode, always loaded by the deployment arm 2 and the TEMPSC 8, drum 12 is always biased to rotate. Accordingly, once brake means 40 is released to allow planet gear carrier 38 to rotate relative to shaft 30, the weight of the TEMPSC 8 and the deployment arm 2 will immediately initiate descent.

Brake means 40 will be discussed in detail later but for present purposes it is noted that planet gear carrier 38 of first stage 36 is fixed to a brake shaft 84 with which a brake drum 86 rotates. The brake per se is preferably in the form of brake band 88 operatively associated with brake drum 86.

Thus, when it is desired to deploy the TEMPSC, brake band 88 is released from brake drum 86, thus freeing planet gear carrier 38 to rotate and to rotate brake shaft 84.

It is necessary that the descent of the deployment arm 2 and the associated TEMPSC 8 be controlled to avoid a too rapid descent which might damage the TEMPSC or cause injury to personnel within the TEMPSC. Furthermore, since a launch of the TEMPSC will normally be in an emergency situation in an extremely hostile environment, it must be anticipated that electric power will not be available, so that the controlling mechanism must be self-contained and designed to operate in a power outage situation.

This function is achieved in the present invention through fall arrestor 90. Fall arrestor 90 comprises those components to the left of brake drum 86 in FIG. 5 and including the left end of brake shaft 84. Fall arrestor 90 operates as follows. Brake shaft 84 is provided with a gear 92 which is fixed to and rotates with brake shaft 84. Thus, when the brake band 88 is released so that shaft 84 rotates, gear 92 also rotates. Gear 92 is operatively connected to gear 94 which is fixed to pump shaft 96. Pump shaft 96 is in turn connected to drive hydraulic pump 98. In one preferred embodiment a series of gears 94 are arranged to be driven by gear 92 to in turn drive a series of hydraulic pumps 98. In one preferred case two such pumps are utilized.

Thus, rotation of brake shaft 84 through a gear train and pump shaft as discussed, drives hydraulic pump 98.

Housing 100 comprises a reservoir which is maintained filled with hydraulic fluid and in which pump 98 is immersed. Therefore, when pump 98 is driven by pump shaft 96, hydraulic fluid is pumped through pump outlet 102 into passage 104. Hydraulic fluid then flows through a flow restrictor 106 into a second passage 108 and hence into brake housing 110. Hydraulic fluid can then circulate through passage 112 back into the reservoir formed by housing 100.

The flow restrictor is chosen to permit hydraulic fluid to flow past at a rate which will by back pressure slow the pump 98. In turn, pump shaft 96, and, through gears 94 and 92, brake shaft 84 will also be slowed. Accordingly, rotation of planet gear carrier 54 will be correspondingly slowed. Therefore, the rate of rotation of cable drum 12 at the other end of gear reduction group 32 will also be slowed. The size of the flow restrictor will be chosen to yield the design speed of deployment.

Figure 6:
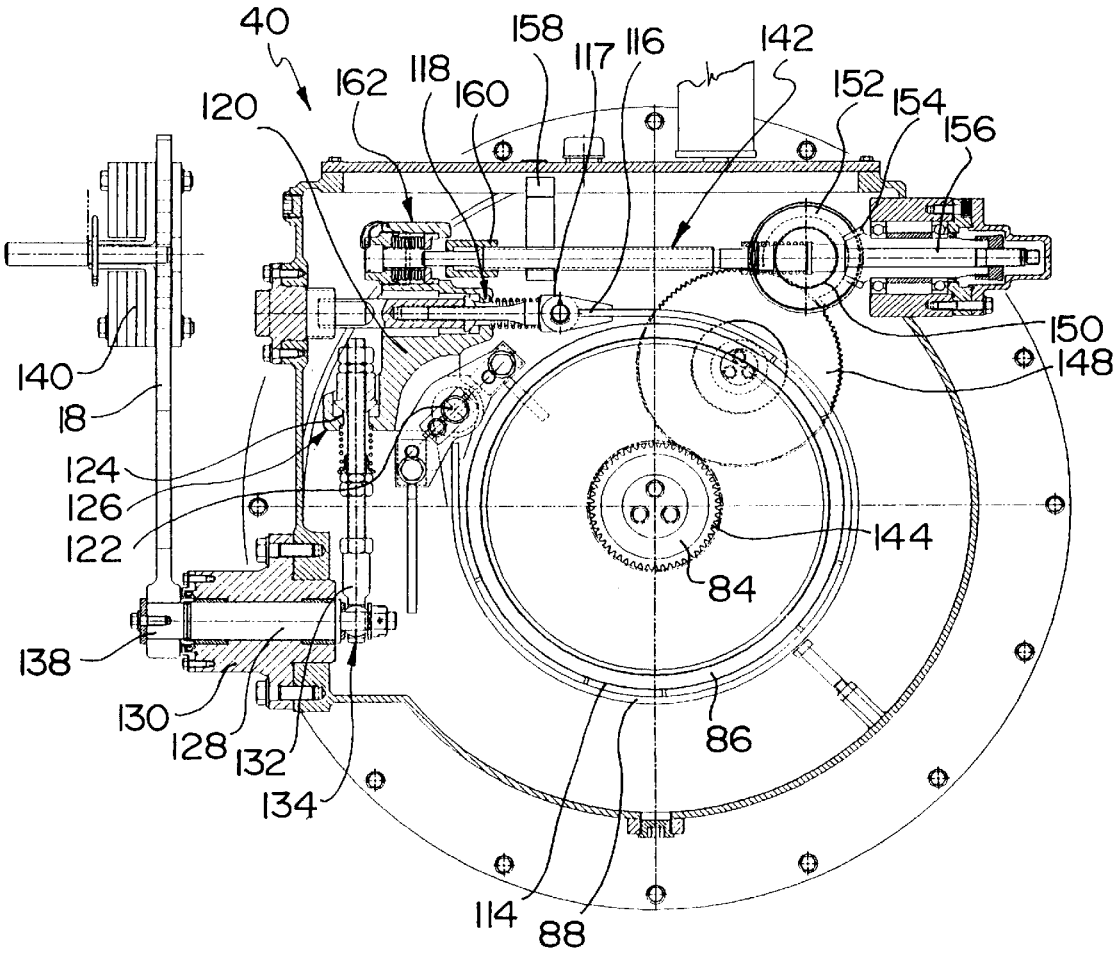
FIG. 6 is a section showing a band brake mechanism for use in a winch according to the invention.

Turning to FIG. 6, brake means 40 comprises, as indicated, a brake drum 86 associated with brake shaft 84 and having brake band 88 operating against outer surface 114 of brake drum 86.

Braking is applied to the system by increasing the tension on brake band 88 to cause frictional engagement with outer surface 114 of brake drum 86. Thus, in simplest terms, the brake is applied by pulling the end 116 of brake band 88 to the left as shown in FIG. 6.

Because of the emergency situations and hostile environment under which the brake will be released to deploy the TEMPSC, the brake must be capable of being released remotely from within the TEMPSC by simple mechanical means. Thus, personnel will in an evacuation situation board the TEMPSC, seal the hatches and then release the brake. One manner of accomplishing this is illustrated.

End 116 of brake band 88 is secured through mechanism 117 in an upper section 118 of lever 120. Lever 120 is pivoted about an axis through point 122. A second mechanism 124 is secured within a second section 126 of lever 120. Thus, pulling the mechanism 124 downward in FIG. 5 will cause the lever 120 to rotate thus exerting tension on mechanism 116 and brake band 88. The rod 128 extending through housing 130 is connected to end 132 of mechanism 124 by an eccentric 134. Thus, the rotation of rod 128 about its axis will cause mechanism 124 to be raised or lowered in FIG. 6 and thus through lever 120 to release or apply tension to brake band 88.

The brake actuator lever 18 is fixed to outer end 138 of rod 128. Thus, manipulation of brake actuator lever 18 will, through the mechanism described, apply or release the brake.

One manner of maintaining the brake in the applied condition utilizes a series of weight plates 140 attached to brake actuator lever 18. Brake actuator lever 18 is fixed to the brake mechanism such that when the brake is in the applied condition, the brake actuator lever 18 will be held by the weights to one side of top dead center point in the path of rotation of lever 18. In order to release the brake, and to ensure that the brake remains in the released condition, brake actuator lever 18 is moved through top dead center so that the weight plates 140 then maintain the mechanism in the brake released condition. The movement of brake actuator lever through top dead center to release the brake can readily be achieved by, for example, a cable extending from the TEMPSC (not shown).

While one embodiment of an arrangement of brake actuator lever 18 has been illustrated, others are possible and some preferable. For example, one highly preferred arrangement (not illustrated), would utilize the weight plates 140 to remove rather than apply the brake. A simple stop arrangement would hold the weights against releasing the brake until a cable pull from the TEMPSC releases the stop. The weights would then fall to release the brake.

In order to facilitate retrieval of the deployment arm 2 where that is required and to prevent damage to either the deployment arm or to the platform support structure, it is advantageous to limit the amount of cable which the winch can let out to that which is sufficient to properly launch the TEMPSC. To achieve this purpose the shuttle mechanism 142 has been provided. This mechanism functions as follows. The gear 144 is fixed to the end 146 of drum 12 to rotate with drum 12. Gear 144 then drives through a gear train consisting of gears 148 and 150 to bevel gear 152.

Bevel gear 152 then drives a companion gear 154 mounted on screw shaft 156.

The shuttle 158 is mounted on the screw shaft 156 and travels back and forth along shaft 156 as drum rotation causes rotation of shaft 156 through the gear train just described.

When the shuttle 158 abuts against the sleeve 160, sleeve 160 applies force against the mechanism 162. Mechanism 162 is fixed to upper section 118 of lever 120. Accordingly, as the shuttle moves against the sleeve 160, the lever 120 is caused to rotate about its pivot axis to thereby reapply brake band 88.

The number of rotations of drum 12 required to move shuttle 158 across shaft 156 to cause reapplication of the brake is chosen to coincide with the desired amount of cable having been let out from drum 12.

Thus, it is apparent that there has been provided in accordance with the invention a winch that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claim as our invention:

1. A winch comprising:

a cable drum selectively rotatable in a deployment mode or a retrieval mode;

a main shaft operatively connected to said drum for operation in said retrieval mode;

a motor operatively connected to said shaft for operation in said retrieval mode;

a fall arrestor operatively connected to said drum for operation in said deployment mode only for controlling speed of deployment of a cable from said drum;

a multi-stage planetary gear system operatively connected between said cable drum and said fall arrestor in said deployment mode, and between said cable drum and said shaft in said retrieval mode; and brake means operatively connected to said planetary gear system and selectively moveable between an applied and a released position for selectively stopping the rotation of said cable drum when said cable drum is in said deployment mode;

and wherein when said brake means is in said released position, said drum is in said deployment mode, and when said brake means is in said applied position, said drum is in said retrieval mode.

2. The winch of claim 1 wherein said motor is operatively connected to drive said winch in a retrieval mode only.

3. The winch of claim 2 wherein said motor has means associated therewith for preventing said motor from operating in a direction reversed from said retrieval mode.

4. The winch of claim 3 wherein said means preventing comprises a backstop.

5. The winch of claim 3 wherein said means preventing comprises a sprag-type clutch.

6. The winch of claim 1 wherein an output shaft of said motor is directly connected through a gearbox to said main shaft.

7. The winch of claim 1 wherein said fall arrestor comprises, in combination, a hydraulic pump having an inlet connected to a source of hydraulic fluid and an outlet connected to at least one flow restrictor;

a pump drive shaft operatively connected to be driven by said cable drum in said deployment mode; and wherein said at least one flow restrictor is chosen to control pump speed.

8. The winch of claim 7 wherein said source of hydraulic fluid is a closed reservoir in which said pump is immersed.

9. The winch of claim 7 wherein said at least one flow restrictor includes an adjustable orifice.

10. The winch of claim 7 including four said flow restrictors.

11. The winch of claim 7 wherein an output shaft of said motor is directly connected through a gearbox to said main shaft; wherein said planetary gear system includes a sun gear, a planet gear carrier, a planet gear and an internal gear; and wherein said sun gear is fixed on said main shaft, a planet gear carrier is operatively connected to said pump drive shaft, and an internal gear is operatively connected to said cable drum; and wherein said brake means selectively holds said planet gear carrier against rotation and releases said planet gear carrier for rotation about said main shaft.

12. The winch of claim 1 wherein said brake means is a band brake.

13. The winch of claim 12 wherein said band brake is normally maintained in said applied position by weight operatively connected to a band of said band brake.

14. The winch of claim 13 comprising, in addition, cable means for remotely moving said brake means from said applied position to said released position.

15. The winch of claim 1 comprising, in addition, limiting means for limiting the length of an associated cable that is unwound from said winch.

16. The winch of claim 1 wherein said limiting means comprises means directly responsive to drum rotation by which said brake means is applied following a predetermined number of rotations of said drum.

* * * * *